US005800234A

United States Patent [19]

Spina et al.

[11] Patent Number: 5,800,234

[45] Date of Patent: Sep. 1, 1998

[54] METHOD FOR MANUFACTURING A METALLIZED LUMINESCENT SCREEN FOR A CATHODE-RAY TUBE

[75] Inventors: Paolo Spina, Ferentino; Patrizia Cinquina, Vasto; Guido Manciocco, Colleferro, all of Italy; Aaron William Levine, Lawrenceville, N.J.

[73] Assignee: Videocolor S.p.A., Anagni, Italy

[21] Appl. No.: 637,028

[22] Filed: Apr. 24, 1996

[30] Foreign Application Priority Data

Dec. 6, 1995 [IT] Italy ..... MI95 A 002563

[51] Int. Cl.[6] ..... H01J 9/22; H01J 9/26

[52] U.S. Cl. ..... 445/45; 445/58; 427/68

[58] Field of Search ..... 445/45, 58; 427/68

[56] References Cited

U.S. PATENT DOCUMENTS

| | | | |
|---|---|---|---|
| 3,067,055 | 12/1962 | Sauliner, Jr. . | |
| 3,317,337 | 5/1967 | Saulnier . | |
| 3,582,390 | 6/1971 | Sauliner . | |
| 4,284,662 | 8/1981 | Matsuzaki et al. | 427/68 |
| 4,327,123 | 4/1982 | Levine et al. | 427/64 |
| 4,339,475 | 7/1982 | Hinosugi et al. | 427/64 |
| 4,409,352 | 10/1983 | Beckerle et al. | 524/405 |
| 4,651,053 | 3/1987 | Kato et al. | 313/466 |
| 4,657,961 | 4/1987 | Nishizawa et al. | 524/297 |
| 4,954,366 | 9/1990 | Pezzulo et al. | 427/68 |
| 5,145,511 | 9/1992 | Patel et al. | 65/42 |
| 5,277,840 | 1/1994 | Osaka et al. | 427/68 |
| 5,556,664 | 9/1996 | Sasa et al. | 427/68 |

FOREIGN PATENT DOCUMENTS

| | | | |
|---|---|---|---|
| 60-37637 | 2/1985 | Japan | 445/58 |
| 62-76133 | 4/1987 | Japan | 445/58 |

*Primary Examiner*—P. Austin Bradley
*Assistant Examiner*—Jeffrey T. Knapp
*Attorney, Agent, or Firm*—Joseph S. Tripoli; Dennis H. Irlbeck; Vincent J. Coughlin, Jr.

[57] ABSTRACT

The present invention relates to a method for manufacturing a metallized luminescent screen for a CRT. At least one phosphor layer is deposited (10) on an inner surface of a faceplate panel to form the luminescent screen. The panel containing the screen is then preheated (12) to a temperature equal to, or in excess of, a minimum film-forming temperature and prewetted (14) by applying water to the screen. An aqueous filming emulsion containing a copolymer of acrylates and methacrylates with an average molecular weight of from 250,000 to 500,000 is applied (16) to the prewetted screen and dried (18) to form a film layer. Next, a layer of aluminum is deposited (20) onto the film layer, and the panel, bearing the metallized screen, is sealed to a funnel by heating the panel and the funnel through a sealing cycle. The sealing cycle(22) has a first rate of temperature increase to a first temperature and a second rate of temperature increase, less than the first rate, to a second temperature. The difference between the first temperature and the second temperature is sufficient to volatilize the film layer. The second temperature is maintained (24) for a period of time sufficient to frit seal the panel to the funnel. The sealed faceplate panel and funnel are then cooled (26).

15 Claims, 2 Drawing Sheets

METHOD FOR MANUFACTURING A METALLIZED LUMINESCENT SCREEN FOR A CATHODE-RAY TUBE

This invention relates to a method for manufacturing a metallized luminescent screen on a faceplate panel of a cathode-ray tube (CRT), and, more particularly, to a method of depositing, on the luminescent screen, a single layer of an aqueous filming emulsion, with very low concentrations of impurities and having a chemical structure and molecular weight that are optimized for clean and efficient bake-out, even in an oxygen-depleted environment, while simultaneously sealing the panel to a funnel of the CRT.

BACKGROUND OF THE INVENTION

In the manufacturing of a color cathode-ray tube, such as a color television picture tube or a color display tube, an aluminum layer is formed over the luminescent screen in order to maximize the brightness of the screen by directing all of the light generated by the phosphors of the screen outwardly through the faceplate panel, toward the viewer. The luminescent screen is made up of a layer of three different light-emitting phosphors; blue, green, and red, deposited as lines or dot, arranged as triads, across the viewing surface of the panel. The surface of these phosphor deposits is irregular because of the variations in particle size of the phosphor materials. Obviously, an aluminum layer applied directly to such deposits would have a highly irregular surface that would tend to conform to the surface contour of the phosphor particles. Irregularities in the aluminum layer destroy the desired property of specular reflection and are to be avoided. Accordingly, a film layer of a volatilizable organic material is provided over the phosphor deposits to provide a smooth substrate upon which the aluminum layer is deposited and to prevent penetration of the aluminum into the screen.

An emulsion film layer is preferred over prior solvent-based filming lacquers because the solvent-based filming lacquers are flammable and pose other environmental concerns. However, a drawback of conventional emulsion films is that most filming emulsion polymers have an average molecular weight greater than $10^6$, and require a dedicated panel bake, prior to frit sealing of the panel to the funnel, in order to eliminate all of the volatilizable constituents from the film layer and the luminescent screen. Thus, such emulsion films require additional manufacturing steps and time to produce a CRT.

U.S. Pat. No. 5,145,511, issued to Patel et al. on Sep. 8, 1992, which is commonly owned, discloses a method of simultaneously baking-out the organic constituents of the luminescent screen and the overlying emulsion filming layer and sealing the panel to the funnel. The filming emulsion of U.S. Pat. No. 5,145,511 is a conventional filming emulsion, disclosed to have an acrylic resin content of about 11 wt. %, or less, which is lower than the resin content of other conventional emulsion films and permits the combined panel bake-out and flit sealing step. A drawback of using the filming emulsion with the lower acrylic resin content is that the resultant filming layer is not as smooth as that obtained with an emulsion having a higher resin content, and may, in some instances, adversely effect uniformity of the aluminum layer and the screen brightness. Additionally, the method described in U.S. Pat. No. 5,145,511 requires a gradual rate of temperature increase and a relatively long baking cycle to volatilize the emulsion film and effect the combined panel bake-out and frit sealing cycle. This increase in manufacturing time decreases manufacturing efficiency and results in higher production costs.

Accordingly, it is desirable to provide an emulsion filming layer that has a higher organic content than that described in U.S. Pat. No. 5,145,511, in order to provide a smoother surface on which to deposit the aluminum layer, while decreasing the average molecular weight of the polymers in the filming emulsion to provide a decrease in the panel bake-out and frit sealing cycle time.

SUMMARY OF THE INVENTION

The present invention relates to a method for manufacturing a metallized luminescent screen for a CRT. At least one phosphor layer is deposited on an inner surface of a faceplate panel to form the luminescent screen. The panel containing the screen is then preheated to a temperature equal to, or slightly in excess of, a minimum film-forming temperature and prewetted by applying water to the screen. An aqueous filming emulsion containing a copolymer of acrylates and methacrylates with an average molecular weight of from 250,000 to 500,000 is applied to the prewetted screen and dried to form a film layer. Next, a layer of aluminum is deposited onto the film layer, and the panel, bearing the metallized screen, is sealed to a funnel by heating the panel and the funnel through a sealing cycle. The sealing cycle has a first rate of temperature increase to a first temperature and a second rate of temperature increase, less than the first rate, to a second temperature. The difference between the first temperature and the second temperature is sufficient to volatilize the film layer. The second temperature is maintained for a period of time sufficient to frit seal the panel to the funnel. The sealed faceplate panel and funnel are then cooled.

BRIEF DESCRIPTION OF THE DRAWINGS

The invention will now be described in greater detail, with relation to the accompanying drawings, in which.

DETAILED DESCRIPTION OF THE INVENTION

The steps of the novel method are similar to those used for making a conventional CRT, except that the aqueous filming emulsion of the present invention has a resin content that is higher than the acrylic resin described in U.S. Pat. No. 5,145,511 and the average molecular weight of the present emulsion polymers is lower than that of the emulsion polymers described in the patent. The higher resin content results in a filming emulsion that is more concentrated than prior filming emulsions, yet can be applied in a single step and baked-out simultaneously with frit sealing of the panel to the funnel, without the need for additional oxygen or air circulation within the tube. The present filming emulsion has been manufactured to the patentees' specification to provide an optimized chemical structure and a relatively low molecular weight that permits the maximization of light output and clean and efficient bake-out of the film layer in a shorter period of time than other emulsion film layers.

Figure 1:
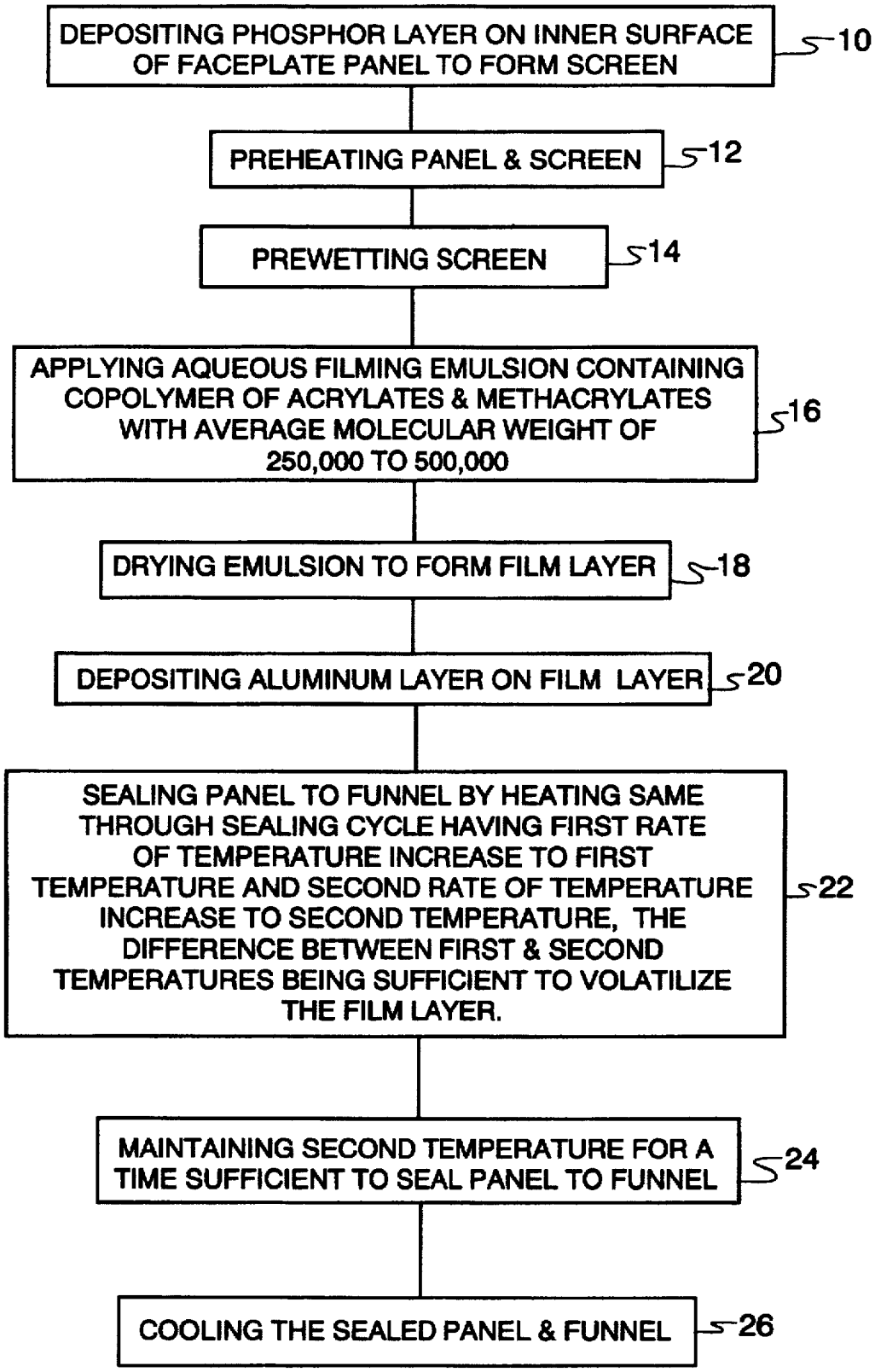
FIG. 1 is a block diagram illustrating the method of the present invention.

The novel method for manufacturing a metallized luminescent screen on an inner surface of a faceplate panel for a cathode-ray tube, such as a color television picture tube or a display tube, is illustrated in the block diagram of FIG. 1. Initially, as indicated at reference numeral 10, at least one, and preferably three layers comprised of blue-emitting, green-emitting and red-emitting phosphor are successively deposited as stripes or dots arranged in color groups, or picture elements, in a cyclic order on the inner surface of the faceplate panel to form a luminescent phosphor screen.

Following formation of the phosphor screen, the panel is detachably secured to a holding fixture capable of tilting and rotating the panel at various speeds ranging from 10 to 205 rpm. The panel containing the phosphor screen is rotated and preheated, as indicated by reference numeral 12, with infrared heaters, to a temperature within the range of 40°–60° C., which is equal to, or slightly in excess of, the minimum film-forming temperature of the aqueous emulsion film described below. The phosphor screen is prewetted, as indicated by reference numeral 14, by applying deionized water to the screen surface as the panel is rotated. The temperature of the water should be between about 15°–50° C.

While the phosphor screen is still wet, an aqueous film-forming emulsion, containing a copolymer of acrylates and methacrylates with an average molecular weight of 250,000 to 500,000, is applied to the rotating panel in a limp stream, as indicated by reference numeral 16. A quantity of 200–500 ml. of the filming emulsion is dispersed onto the rotating panel by the limp stream which has a trajectory that contacts the surface of the phosphor screen substantially tangentially thereto, and thus passes along the surface and drains therefrom, in the manner described in U.S. Pat. No. 3,652,323, issued to B. K. Smith on Mar. 28, 1972. After the surface of the screen is coated with the filming emulsion, the panel is rotated at speeds ranging between 10 and 205 rpm to uniformly disperse the filming emulsion over the phosphor layer and to remove excess emulsion. The water provided by prewetting the panel prevents the film-forming emulsion from penetrating into the screen by providing additional water that fills any voids between phosphor particles. Thus, the filming emulsion provides a smooth surface overlying the phosphors.

The filming emulsion is dried, as indicated by reference numeral 18, by heating the panel to a temperature within the range of 55°–60° C., to form a filming layer. Next, as indicated by reference numeral 20, the phosphor screen and the overlying filming layer are metallized in the manner similar to that described in U.S. Pat. No. 3,067,055, issued on Aug. 5, 1959, and U.S. Pat. No. 3,582,390, issued on Jun. 1, 1971, both to T. A. Saulnier, Jr. Preferably, an aluminum layer is deposited by evaporating a quantity of aluminum metal onto the filming layer. The function of the aluminum layer is to provide a conductive substrate over the phosphor screen to facilitate applying a potential thereto during operation of the tube and to reflect light, emitted by the phosphors, outwardly, through the viewing portion of the glass faceplate, to the viewer. As described above, the specular reflectance of the aluminum is maximized and the light output of the phosphors is optimized by providing a smooth filming layer onto which the aluminum layer is deposited.

The filming emulsion may be prepared in the following manner.

Solution A—is an aqueous emulsion containing about 46 wt. % of a dispersion of a copolymer of acrylates and methacrylates, having an average molecular weight within the range of 250,000–500,000, in deionized water, having a pH at 20° C. of 7.0–8.3 and a viscosity of 50–120 mpa.s. An emulsion of this type is commercially available under the name REPOLEM 2161, from Elf Atochem Italia, Boretto, Italy. The solid concentration of REPOLEM 2161 in the filming emulsion is preferably in the range of 16–18 wt. %.

Solution B—is a plasticizer, such as butyl carbitol acetate, that improves the smoothness of the emulsion film and lowers its film-forming temperature. Preferably, the solid concentration of the plasticizer is within the range of 0.5–5 wt. % of the solid content, or concentration, of the REPOLEM 2161 in the filming emulsion.

Solution C—is an aqueous solution of a 2 wt. % solution of a boric acid/pva complex compound prepared by mixing a suitable quantity of Unisize HA-70, available from Air Products Co., New York, N.Y., with deionized water. This material assists in the coalescence of the emulsions particles during the drying of the filming emulsion thereby increasing the specular reflectivity of the aluminum layer, and prevents application-pattern defects in the screen. The concentration of Unisize HA-70 is within the range of 0.1–0.5 wt. % of the solid content, or concentration, of the REPOLEM 2161 in the filming emulsion.

Solution D—is an aqueous solution containing about 30 wt. % of colloidal silica particles, such as the solution commercially sold under the name Ludox AM, marketed by E. I. duPont de Nemours, Wilmington, Del. Ludox improves the adherence of the aluminum layer to the phosphor after bakeout of the screen. The concentration of Ludox AM is within the range of 2–4 wt. % of the solid content, or concentration, of the REPOLEM 2161 in the filming emulsion.

Deionized water constitutes the balance of the filming emulsion.

EXAMPLE

The filming emulsion according to the present invention has the following composition:

351 g. of solution A is combined with 8.1 g. of solution B, 13.7 g. of solution C, and 16.1 g. of solution D. To this mixture 611.1 g. of deionized water is added to provide one liter of filming emulsion. The emulsion is mixed for 1 hour before being applied to the screen.

Figure 2:
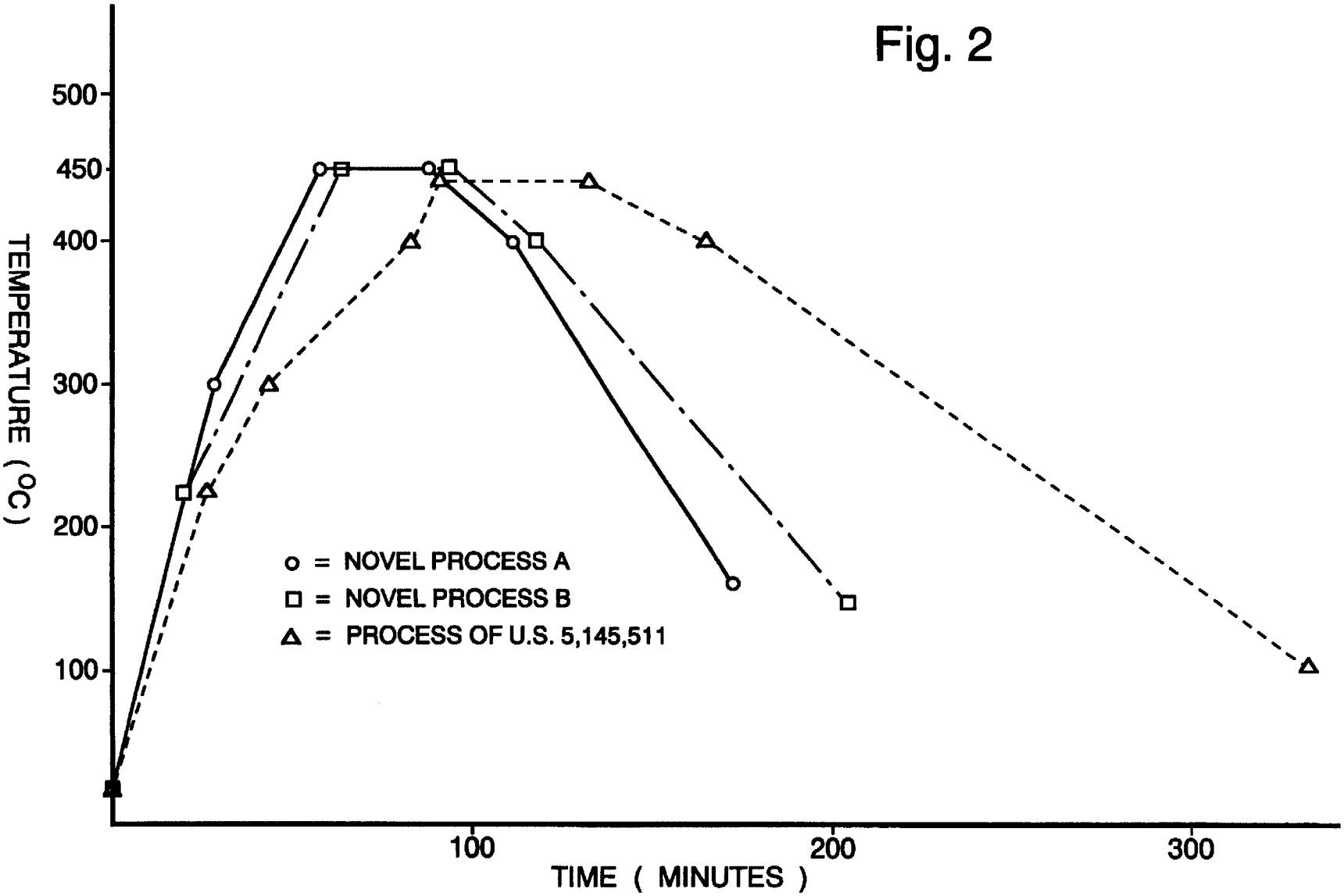
FIG. 2 is a graph representing the temperature profiles experienced by a faceplate panel and funnel of a CRT passing through a sealing furnace for two different embodiments of the present combined panel bake-out and frit sealing cycle (curves A and B), and for a prior combined panel bake-out and frit sealing cycle (curve C).

Screens prepared using this filming emulsion do not require a dedicated panel bake-out prior to frit sealing, but can be baked-out during the same sealing cycle in which the faceplate panel is frit sealed to a funnel of the CRT envelope. The faceplate panel is placed onto a funnel that has a quantity of a glass frit applied to the sealing edge that is in contact to the corresponding sealing edge of the faceplate panel. Both the panel and the funnel are supported on a device that aligns the respective members as they pass through a sealing lehr. Surprisingly, because the present filming emulsion utilizes a copolymer of acrylates and methacrylates having an average molecular weight within the range of 250,000–500,000, which is substantially lower than that of other emulsion filming resins, the total elapsed sealing time for the present filming emulsion is substantially shorter than that for a conventional filming emulsion using only acrylate resin copolymers that has an average molecular weight of more that $10^6$. The combined screen bake-out and frit sealing cycle is indicated at reference numeral 22. The frit sealing portion of the cycle is indicated by reference numeral 24, and the cooling portion of the cycle by reference numeral 26. The temperature profiles of two sealing cycles suitable for use with the present emulsion are identified as curves A and B, respectively, in FIG. 2. Curve C represents the combined screen bake-out and frit sealing cycle for a filming resin containing only acrylate resin copolymers, as described in U.S. Pat. No. 5,145,511.

As shown in the three curves, the present filming emulsion (curves A and B) permits a faster rate of temperature increase to the ultimate frit sealing temperature (440°–450° C.) than with the prior filming emulsion (curve C). The bake-out and sealing cycle for curve A is given in TABLE 1, that of curve B is given in TABLE 2 and the prior bake-out and sealing cycle in TABLE 3.

TABLE 1

| Temp. (°C.) | Rate of Change (°C./min.) | Elapsed Time (min.) |
|---|---|---|
| 25–300 | +9.8 | 28 |
| 300–450 | +5.0 | 58 |
| 450 | 0 | 88 |
| 450–400 | −2.0 | 112 |
| 400–165 | −4.0 | 172 |

TABLE 2

| Temp. (°C.) | Rate of Change (°C./min) | Elapsed Time (min.) |
|---|---|---|
| 25–225 | +9.8 | 20 |
| 225–450 | +5.0 | 65 |
| 450 | 0 | 95 |
| 450–400 | −2.0 | 120 |
| 400–145 | −3.0 | 205 |

TABLE 3

| Temp. (°C.) | Rate of Change (°C./min) | Elapsed Time (min.) |
|---|---|---|
| 25–225 | +7.4 | 27 |
| 225–300 | +4.8 | 43 |
| 300–400 | +2.5 | 83 |
| 400–440 | +4.8 | 91 |
| 440 | 0 | 133 |
| 440–400 | −1.2 | 166 |
| 400–100 | −1.8 | 333 |

Screens made using the present filming emulsion containing REPOLEM 2161 have a white light output substantially equal to that of screens made using a standard filming emulsion, similar to that described in U.S. Pat. No. 5,145,511, and superior to that of a lacquer spray film. Additionally, the white light screen efficiency of screens made using the present filming emulsion is superior to that of either the standard filming emulsion of the lacquer spray film. The results are presented in TABLE 4.

TABLE 4

| Parameter | REPOLEM 2161 Emulsion Film | Standard Emulsion Film | Lacquer Spray Film |
|---|---|---|---|
| White Light Output (FL/mA) | 34.0 | 34.3 | 31.5 |
| White Light Screen Efficiency (L/W) | 34.7 | 33.5 | 32.0 |

What is claimed is:

1. A method for manufacturing a metallized luminescent screen for a cathode-ray tube including the steps of depositing at least one phosphor layer on an inner surface of a faceplate panel to form a luminescent screen, preheating said panel containing said screen to a temperature equal to, or in excess of, a minimum film-forming temperature, prewetting said screen by applying deionized water thereto, applying an aqueous filming emulsion containing a copolymer of acrylates and methacrylates with an average molecular weight of from 250,000 to 500,000 onto said prewetted screen, drying said emulsion to form a film layer, depositing a layer of aluminum onto said film layer, sealing said faceplate panel to a funnel by heating said panel and funnel through a sealing cycle having a first rate of temperature increase of about 9.8° C./min to a first predetermined temperature within the range of about 225°–300° C., a second rate of temperature increase of about 5° .C/min to a second predetermined temperature of about 450° C., the range between said first and second predetermined temperatures being sufficient to volatilize said film, said second predetermined temperature of about 450° C. being maintained for a period of time sufficient to frit seal said panel to said funnel, and cooling said faceplate panel and said funnel at a rate within the range of 2°–4° C. to a temperature within the range of 145°–165° C.

2. The method as described in claim 1, wherein the prewetting step further includes rotating said faceplate panel while applying the deionized water having a temperature between about 15°–50° C.

3. The method as described in claim 1, wherein the step of depositing said aqueous filming emulsion further includes spinning said panel to remove the excess emulsion.

4. The method as described in claim 1, wherein the step of drying said emulsion includes heating said faceplate panel within the range of 55°–60° C.

5. The method as described in claim 1, wherein said aqueous filming emulsion consisting essentially of 16–18 wt. % of said copolymer of acrylates and methacrylates, butyl carbitol acetate, within the range of 0.5–5 wt. % of the concentration of said copolymer, a boric acid/pva complex compound, within the range of 0.1–0.5 wt.% of the concentration of said copolymer, colloidal silica, within the range of 2–4 wt. % of the concentration of said copolymer, and the balance, deionized water.

6. A method for manufacturing a metallized luminescent screen for a cathode-ray tube including the steps of depositing at least one phosphor layer on an inner surface of a faceplate panel to form a luminescent screen, preheating said panel containing said screen to a temperature equal to, or in excess of, a minimum film-forming temperature, prewetting said screen by applying water thereto, applying an aqueous filming emulsion containing a copolymer of acrylates and methacrylates with an average molecular weight of from 250,000 to 500,000 onto said prewetted screen, drying said emulsion to form a film layer, depositing a layer of aluminum onto said film layer, sealing said faceplate panel to a funnel by heating said panel and funnel through a sealing cycle having a first rate of temperature increase to a first temperature, a second rate of temperature increase to a second temperature, the difference between said first temperature and said second temperature being sufficient to volatilize said film layer, said second temperature being maintained for a period of time sufficient to frit seal said panel to said funnel, and cooling said faceplate panel and said funnel.

7. The method as described in claim 6, wherein the prewetting step further includes rotating said faceplate panel while applying the water having a temperature between about 15°–50° C.

8. The method as described in claim 6, wherein the step of depositing said aqueous filming emulsion further includes spinning said panel to remove the excess emulsion.

9. The method as described in claim 6, wherein the step of drying said emulsion includes heating said faceplate panel within the range of 55°–60° C.

10. The method as described in claim 6, wherein said aqueous filming emulsion consisting essentially of 16–18 wt. % of said copolymer of acrylates and methacrylates, butyl carbitol acetate, within the range of 0.5–5 wt. % of the concentration of said copolymer, a boric acid/pva complex compound, within the range of 0.1–0.5 wt.% of the concentration of said copolymer, colloidal silica, within the range of 2–4 wt. % of the concentration of said copolymer, and the balance, deionized water.

11. The method as described in claim 6, wherein said first temperature is within the range of about 225°–300° C.

12. The method as described in claim 11, wherein said first rate of temperature increase is about 9.8° C./min.

13. The method as described in claim 12, wherein said second temperature is about 450° C.

14. The method as described in claim 13, wherein said second rate of temperature increase is about 5° C./min.

15. The method as described in claim 14, wherein said second temperature is maintained for about 30 min.

* * * * *